US005398936A

United States Patent [19]

Kluttz et al.

[11] Patent Number: 5,398,936

[45] Date of Patent: Mar. 21, 1995

[54] GOLFING APPARATUS AND METHOD FOR GOLF PLAY SIMULATION

[75] Inventors: James W. Kluttz; Edgar P. Roberts; Charles L. Crockett, all of Winston-Salem, N.C.

[73] Assignee: Accu-Sport International, Inc., Winston-Salem, N.C.

[21] Appl. No.: 117,104

[22] PCT Filed: Apr. 29, 1993

[86] PCT No.: PCT/US93/04027

§ 371 Date: Sep. 10, 1993

§ 102(e) Date: Sep. 10, 1993

Related U.S. Application Data

[63] Continuation-in-part of Ser. No. 875,752, Apr. 29, 1992, Pat. No. 5,303,924.

[51] Int. Cl.[6] ..... A63B 69/36

[52] U.S. Cl. ..... 273/185 B; 273/185 A; 273/87 R; 273/87.2; 273/433; 434/252

[58] Field of Search ..... 273/185 A, 185 B, 87 R, 273/87.2, 35 R, 433; 434/252

[56] References Cited

U.S. PATENT DOCUMENTS

| | | | |
|---|---|---|---|
| 3,194,562 | 7/1965 | Speiser . | |
| 3,508,440 | 4/1970 | Murphy . | |
| 3,577,205 | 5/1971 | Hobrough . | |
| 3,620,537 | 11/1971 | Conklin . | |
| 3,712,624 | 1/1973 | Conklin . | |
| 3,729,315 | 4/1973 | Conklin et al. | 273/185 B X |
| 4,005,261 | 1/1977 | Sato et al. . | |
| 4,025,718 | 5/1977 | Paretti . | |
| 4,150,825 | 4/1979 | Wilson | 273/185 B |
| 4,160,942 | 7/1979 | Lynch et al. | 434/252 X |
| 4,192,510 | 3/1980 | Miller . | |
| 4,283,056 | 8/1981 | Miller . | |
| 4,343,469 | 8/1982 | Kunita et al. . | |
| 4,437,672 | 3/1984 | Armantrout et al. . | |
| 4,572,512 | 2/1986 | Tegart . | |
| 4,612,575 | 9/1986 | Ishman et al. . | |
| 4,662,635 | 5/1987 | Enokian | 273/94 |
| 4,673,183 | 6/1987 | Trahan . | |
| 4,696,474 | 9/1987 | Tegart . | |
| 4,774,589 | 9/1988 | Rowland . | |
| 4,890,833 | 1/1990 | Lantz et al. | 273/85 G |
| 4,898,388 | 2/1990 | Beard, III et al. . | |
| 5,029,866 | 7/1991 | Beard, III et al. . | |
| 5,053,876 | 10/1991 | Blissett et al. . | |
| 5,056,068 | 10/1991 | Barnes . | |
| 5,075,776 | 12/1991 | Cheung . | |
| 5,102,140 | 4/1992 | Vincent . | |
| 5,226,660 | 7/1993 | Curchod | 273/185 B |
| 5,269,519 | 12/1993 | Malone | 273/85 G |
| 5,277,426 | 1/1994 | Gerpheide et al. | 273/185 B |

FOREIGN PATENT DOCUMENTS

| | | | |
|---|---|---|---|
| 4322672 | 11/1992 | Japan | 273/185 B |
| 2005549 | 4/1979 | United Kingdom . | |
| 2154146 | 9/1985 | United Kingdom | 273/185 B |

OTHER PUBLICATIONS

Electronics Engineers' Handbook; Donald G. Fink and Donald Christiansen, Editors, Third Edition, Section 4, "Information, Communication, Noise and Interference"; John B. Thomas; pp. 4–1 through 4–50.

D&B Records; The Dun & Bradstreet Magazine for Small Business Management Sep./Oct. 1991 Issue.

*Primary Examiner*—Vincent Millin

*Assistant Examiner*—Kerry H. Owens

*Attorney, Agent, or Firm*—Bell, Seltzer, Park & Gibson

[57] ABSTRACT

The golfing apparatus according to the present invention has a golf shot file providing a representation of at least one actual golf shot by the user. The golf shot representation includes at least a time and a distance of a golf ball travel. The apparatus also has a golf course file for providing a geographic representation of at least a portion of a golf course and simulation means for combining selected portions of the golf shot file and selected portions of the golf course file to simulate at least one golf shot on the selected portions of the golf course based upon at least one actual golf shot by the user. An image display responsive to the simulation means displays at least one simulated golf shot on the selected portions of the golf course. The method for simulating golf play using actual golf shots by the user includes the steps of providing data representative of at least one actual recorded golf shot by the user, providing data representative of at least a portion of a golf course, and combining selected portions of the golf shot data and selected portions of the golf course data to simulate at least one golf shot on-the selected portions of the golf course based upon at least one actual golf shot by the user.

30 Claims, 6 Drawing Sheets

GOLFING APPARATUS AND METHOD FOR GOLF PLAY SIMULATION

This application is a continuation-in-part of U.S. patent application Ser. No. 07/875,752, which was filed on Apr. 29, 1992, now U.S. Pat. No. 5,303,924.

FIELD OF INVENTION

This invention relates to a golfing apparatus and, more particularly, to an apparatus for simulating golf course play using actual pre-recorded golf shots by the user.

BACKGROUND OF THE INVENTION

Various golfing simulation systems have been developed and used over the years for simulating play on a golf course, including famous golf courses such as Pebble Beach or Augusta National. These conventional golfing simulation systems typically are used at home and involve playing a simulated hole or golf course using computer simulated shots by the user. Although these type of systems may somewhat educate the user about the game of golf, these systems produce only nominal, if any, information representative of the player's actual ability and/or a simulation of the player's interaction with the golf course based on the player's skills. Without some type of actual correlation to the user's actual golf skills, these systems primarily serve as games for promoting golf.

Other golfing simulation systems have also been developed that use actual shots taken toward a simulated screen or onto a distance-marked driving range. These systems allow the golfer to hit a golf ball and then either simulate the distance of travel or manually enter a shot into a computer for playing a simulated course. These systems, however, are not practical for home use. Moreover, simulation accuracy is still limited because the quality of information of user's actual golf shot is limited with these devices.

The common assignee of the present invention has developed systems using acoustics and/or optics for tracking a golf ball during actual flight and for determining the impact point of the ball. Examples of these systems may be seen in U.S. Pat. No. 4,898,388 by Beard, III et al. entitled "*Apparatus And Method For Determining Projectile Impact Locations*"; U.S. Pat. No. 5,029,866 by Beard, III et al. entitled "*Apparatus And Method For Determining Projectile Impact Locations*"; U.S. Pat. No. 5,056,068 by Barnes entitled "*Apparatus And Method For Detecting Sharp Signal Variations Against Ambient Signals.*" These systems have made major improvements which increase the value and enjoyment of driving range practice.

Despite substantial improvements in golf simulation systems and despite substantial commercial interest in these systems, the present choices for golfing simulation systems are either playing the simulated golfing systems at home on a computer with no real simulation of the golfer's actual skills or traveling to a driving range.

SUMMARY OF THE INVENTION

The present invention provides a golfing apparatus and method for simulating golf play using data representative of actual golf shots by the user. The user's actual golf shots are recorded on a recording medium, for example, at a driving range or on a golf course by one or more techniques such as by use of optics, acoustics, radar, or the like. The recorded actual shots of the user are then transferred to a golf course simulation system, e.g., at the golf range or in a home, for interaction therewith. The play of the simulated golf course is performed using the golfer's actual shots and not the simulated shots as with conventional systems.

In preferred embodiments, the golfing apparatus of the invention has a golf shot file providing a representation of at least one actual golf shot by the user. The golf shot representation includes at least a time and a distance of actual golf ball travel. The apparatus also has a golf course file for providing a geographic representation of at least a portion of a golf course and simulation means for combining selected portions of the golf shot file and selected portions of the golf course file to simulate at least one golf shot on the selected portions of the golf course based upon the actual golf shot by the user. An image display responsive to the simulation means displays at least one simulated golf shot on the selected portions of the golf course.

The golfing apparatus may also have means for monitoring a golf shot by a golfer, such as optic, acoustic, and/or radar tracking devices, and a means for generating the golf shot file of the golfer's actual golf shots, including at least a time and a distance of a golf ball travel. Input means, such as a joystick or keyboard may also be provided to enable the user to select predetermined portions of the golf shot file during simulation. The simulation means may include extrapolation means for extrapolating actual golf shot data based on the conditions of the simulated selected portions of the golf course.

Because the golfing apparatus uses data representative of actual golf shots by the user, the invention provides quality information for practical home use and/or simulation accuracy for the user's actual golfing skills. Thus, the actual data used in accordance with the invention provides for improved interaction with different golf course contours and can provide for accurate simulation of roll, weather conditions, course quality and like information on various courses. Because the system of the invention provides a reliable simulation based on actual golfing skills, the user does not have to travel to a golf course or golfing range every time the user wants to practice and/or evaluate golfing skills. If the golfer so chooses, however, the golfer may also use the golfing apparatus of the present invention for simulation play at the driving range or portion of a golf course, i.e., a par three course so that an interactive teaching and instructional simulation system is also provided.

Further, by using the data representative of actual golf shots by the user, the user can test the user's skills against various golf courses, weather conditions, obstacles, and other golfers, including, for example, players on the Professional Golfing Association ("PGA") tours. Because the invention uses actual golf shot data which includes the actual time and actual distance of golf ball travel, the height of the golf ball during flight can be calculated and from this information a trajectory path simulated. If the simulated trajectory path intersects an obstacle, i.e., a tree, then the simulated golf ball will strike the simulated obstacle causing the ball to fall short of the projected distance of travel. The golfing apparatus can therefore be both an effective teaching and training system for various golf courses under simulated conditions and a game simulation system for leisure enjoyment purposes.

In method embodiments of the invention, methods for simulating golf play using recorded actual golf shots by the golfer may include the steps of recording actual golf shots by a golfer, providing data representative of actual recorded golf shots by the golfer, providing data representative of at least a portion of a golf course, simulating golf ball interaction with at least portions of a golf course, and displaying simulated golf play on an image display.

DESCRIPTION OF THE DRAWINGS

Some of the features and advantages of the present invention having been stated, others will become apparent as the description proceeds when taken in conjunction with the accompanying drawings, in which.

DETAILED DESCRIPTION OF ILLUSTRATED EMBODIMENTS

The present invention now will be described more fully hereinafter with reference to the accompanying drawings in which illustrated embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
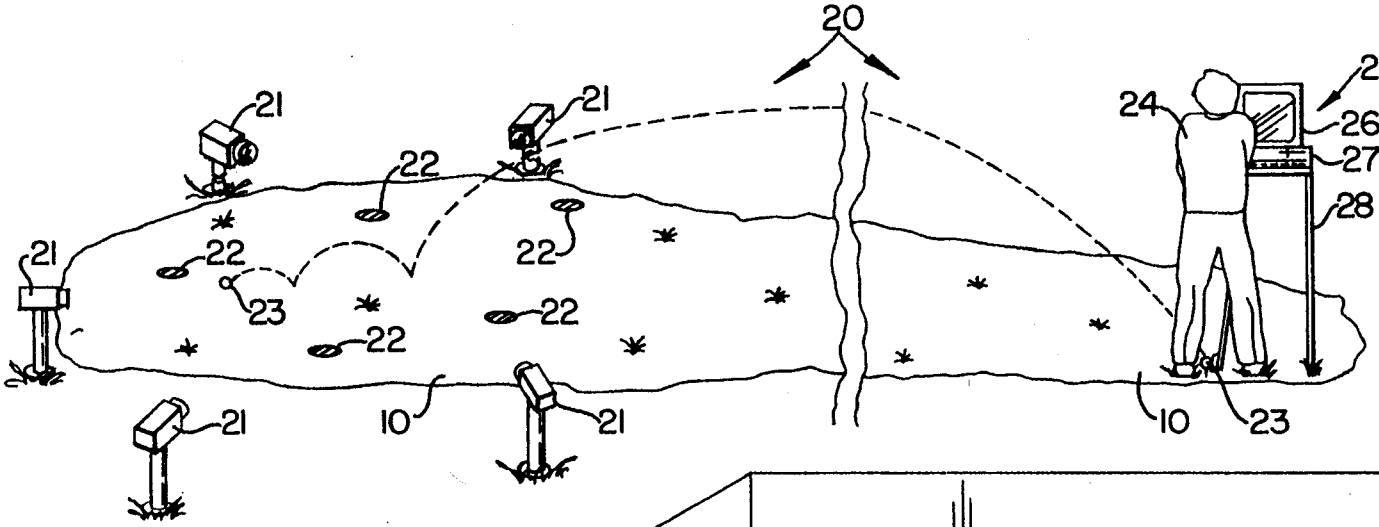
FIG. 1 is an environmental view of a golfer taking actual golf shots at a driving range and having the shots recorded for use with a golfing apparatus according to the present invention.

Referring more particularly to the drawings, FIG. 1 is an environmental view of a golf driving range 10 having a golf ball tracking apparatus broadly designated at 20. The golf ball tracking apparatus 20 is illustrated as the combination of a plurality of video cameras 21 and acoustic sensors 22 which can track a single golf ball hit by a golfer such as illustrated or can track a plurality of golf balls hit by one or more golfers. The video cameras 21 and acoustic sensors 22 track the actual flight and roll of each golf ball 23 hit by the golfer 24. The golf ball tracking apparatus 20 tracks the golf ball 23 and records the tracking information by generating a data file representative of the golfer's actual golf shot. The data preferably includes at least a time and a distance of the golf ball travel, i.e., flight and roll.

Also, other tracking systems apparent to those skilled in the art, such as radar or any combination of radar, optics, or acoustics, may also be used. Examples of these optical and acoustic tracking systems may be seen in the commonly assigned U.S. Pat. No. 4.,898,388 by Beard, III et al. entitled "*Apparatus And Method For Determining Projectile Impact Locations*"; U.S. Pat. No. 5,029,866 by Beard, III et al. entitled "*Apparatus And Method For Determining Projectile Impact Locations*"; U.S. Pat. No. 5,056,068 by Barnes entitled "*Apparatus And Method For Detecting Sharp Signal Variations Against Ambient Signals*"; copending U.S. patent application Ser. No. 07/875,752 by Roberts et al. entitled "*Golf Game Simulating Apparatus And Method*"; and co-pending U.S. patent application Ser. No. 07/968,994 by Rankin et al. entitled "*Apparatus And Method For Tracking The Flight Of A Golf Ball*" which are hereby incorporated herein by reference.

Figure 2:
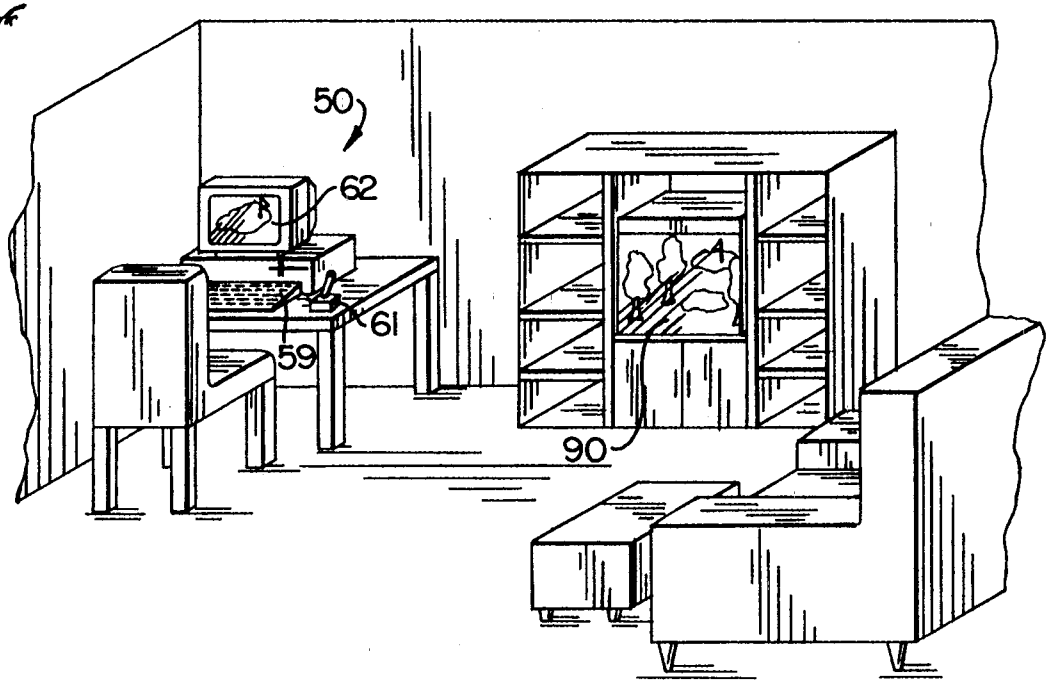
FIG. 2 is an environmental view a golfing apparatus adapted for home use according to the present invention.
Figure 3:
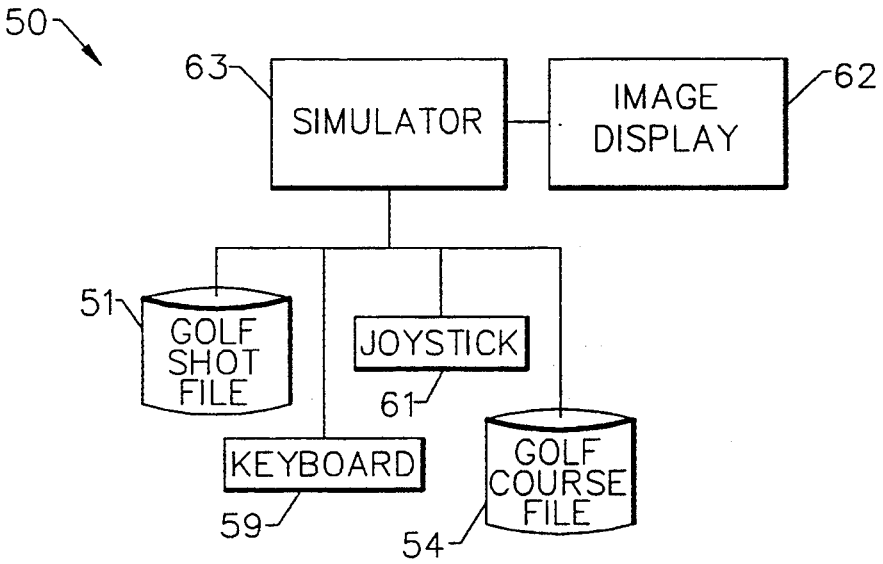
FIG. 3 is a schematic block diagram of a golfing apparatus according to the present invention.
Figure 4:
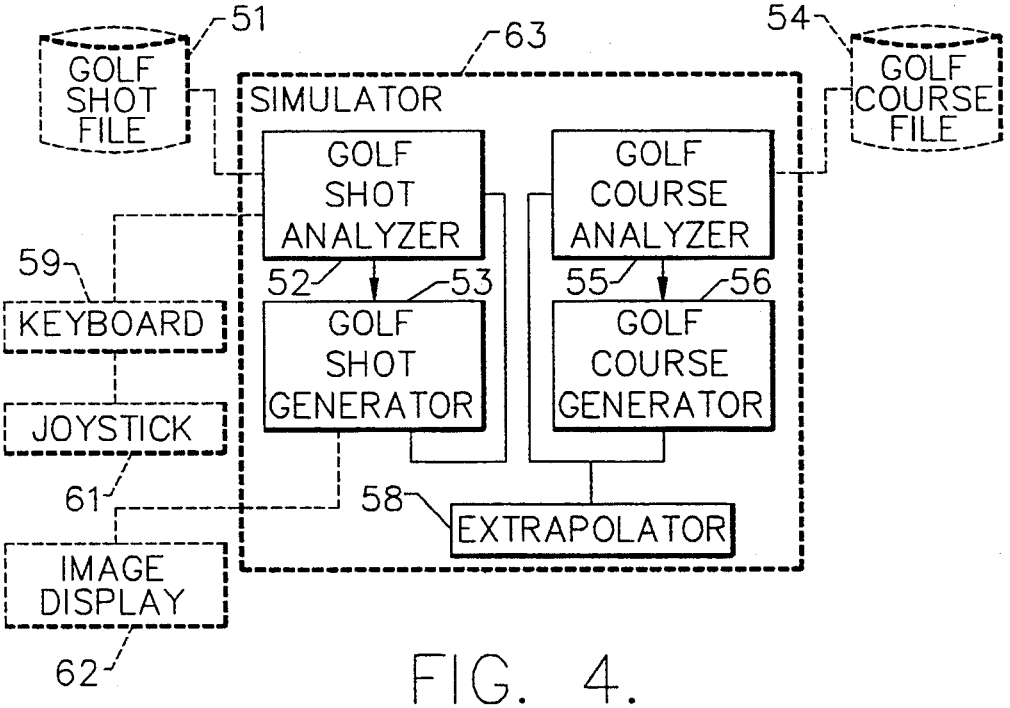
FIG. 4 is a schematic block diagram of a simulator of the golfing apparatus in communication with other various elements of the golfing apparatus according to the present invention.

FIGS. 3 and 4 are schematic block diagrams of one preferred golfing apparatus 50 according to the present invention. The apparatus 50, shown in the form of a micro-computer system, may be used at the golfing range 10 or the like as one embodiment 25 shown in FIG. 1 or may be used at home in a second embodiment 50 as shown in FIG. 2. For ease of discussion purposes, the second embodiment 50 of the golfing apparatus will be further described herein, but it will be understood that a similar description would follow for the first embodiment 25.

The golfing apparatus 50 includes a golf shot file 51 for providing representations of at least one actual golf shot by the user. The golf shot file 51 preferably includes a plurality of actual golf shots with each golf club in a typical set Of golf clubs to thereby form a database or data file for the user to select from during simulated play. The golf shot file 51 preferably includes at least the actual time and actual distance of the golf ball travel with each golf shot, and may also include data representative of weather conditions, height of ball travel, actual or simulated roll of the ball, type of ball used, air density, and other information about the shots and environment surrounding the actual golf shot taken by the golfer 24. The golf shot file 51 also preferably includes a plurality of drives, putts, chips, sand shots, and the like by the user. Generally enough actual golf shot preferably will form the golf shot file 51 so that the user can effectively play an 18-hole golf course.

A golf course file 54 provides a geographic representation of at least a portion of a golf course, such as a few holes or a driving range, but preferably provides representations of a complete golf course. The golf course file 54 has data representative of a simple or complex contour of a golf course, obstacles on the course, and other details about a particular course. A simulator 57 combines selected portions of the golf shot file 51 and selected portions of the golf course file 54 to simulate at least one golf shot on the selected portions of the golf course based upon at least one actual golf shot by the user. The simulator 57 preferably has simulations of striking a golf ball, including golfer stance and swing, simulations of golf ball flight, simulations of the roll of a golf ball, and simulations of weather conditions, such as wind speed, rain, air density, temperature, and humidity. The simulator 57 has an extrapolator 58 that extrapolates the recorded actual-golf shot file based on the geographic data, and the conditions of the simulated selected portions of the golf course. An image display 62, shown in the form of a cathode ray tube ("CRT"), responsive to the simulator 51 displays the simulated actual golf shot on the selected portions of the golf course. It will be apparent to those skilled in the art that various other image displays may be used such as a liquid crystal display ("LCD"), an electroluminescent display, a light emitting diode ("LED") display, a vacuum fluorescent ("VF") display, or combinations of these displays.

Because the golfing apparatus 50 uses data representative of actual golf shots by the user, the invention provides quality information for practical home use and/or simulation accuracy for the user's actual golfing skills. The user does not have to travel to the golf course or golfing range 10 every time he wants to practice his golfing skills. If the golfer so chooses, however, he may also use the golfing apparatus 50 of the present invention for simulation play at the driving range 10 or portion of a golf course, i.e., a par three course so that an interactive teaching and instructional simulation system is also provided.

Further, by using the data representative of actual golf shots by the user, the user can test his skills against various golf courses, weather conditions, and other golfers, including, for example, players on the Professional Golfing Association ("PGA") tours. The golfing apparatus 50 can therefore be both an effective teaching and training system and a game simulation system for leisure enjoyment purposes either at home or at the driving range 10.

Also, as shown in FIGS. 3 and 4, a keyboard 59 or a joystick 61 may be used to input data from the user by interaction therewith. The golf shot file 51 responds to the use of the keyboard 59 and the joystick 61 by the user in order to select a particular club or set of instructions from the database of shots. The plurality of actual golf shots are analyzed by a golf shot analyzer 52 according to a predetermined set of instructions and the selected shot is generated by a golf shot generator 53 in response to the user input with the keyboard 59 and the joystick 61. The shots may be selected at random form the golf shot data file 51, but preferably based on a selected club by the user for the simulated shot shown, i.e., a sand wedge for a sand shot or a 2-wood for a long drive.

The simulator 63, preferably in the form of electronic circuitry having .a microprocessor operating under stored program control, communicates with the golf shot file 51, the golf course file 54, and the image display 62 in response to the real time interaction of the user with the joystick 61 so that the user's actual golf shots are used to play at least portions of the simulated golf course. The microprocessor for the simulator 63 may include a separate memory or the memory may be included within the microprocessor. Also, the simulator 63 may be in the form of a central processing unit, a distributed processing system, or other types of data processing or simulation system apparent to those skilled in the art. Further, it will also be apparent to those skilled in the art that various other hardware or hardware and software combinations operating under stored program control may be used as the elements shown in FIGS. 3 and 4.

The stored program control for the simulator 63 will preferably be from conventional simulation system software or programs which is modified for use with an actual golf shot file produced or generated by the user from actual recorded golf shots. Simulation theory, and related mathematical calculations, extrapolations, and analysis of simulation theory, is generally known to those skilled in the art. Numerous simulation software systems, including golf software simulation systems are known to the skilled artisan and such systems can readily be modified to employ actual golf shot data in accordance with this invention. Custom simulations of stored program control, however, may also be used for the present invention to form the simulator 63 as shown in the drawings.

The golf shot file 51 preferably includes at least the recorded data representative of the actual time and the actual distance of golf ball travel and preferably includes data representative of the time and the distance for an initial actual impact point and can also include the time and the distance of the actual roll to a resting position. It will also be understood by those skilled in the art that time and velocity data can be used to derive distance and, therefore, this type of data is also considered representative of actual time and distance. From the time and distance data, various mathematical calculations and other analysis can be performed in cooperation with the simulation software, and the golf course file 54, for providing the present invention. The time and distance data can be used to extrapolate an initial impact point and roll for the simulated ball on a particular portion of the simulated geographical contour of the simulated golf course. Also, the time and distance data of the actual golf ball travel can be used to calculate and extrapolate whether the simulated ball would strike a particular obstacle, such as a tree, water, sand trap, high grass or the like, on the simulated golf course. Because the time and distance data are provided, the height of the golf ball during flight can be mathematically calculated and from this information a trajectory path simulated. If the trajectory path intersects an obstacle, i.e., a tree, then the simulated ball would strike the simulated obstacle causing the ball to fall short or otherwise of the actual distance of travel when the golfer hit the actual shot at the driving range.

Also, for example, the simulated roll distance of a golf ball may be determined based upon a ratio of the linear flight distance to the square of the flight time. Since there is a correlation between logarithm (base 10) of the roll distance and the ratio of the flight distance ($D_f$) to the square of the flight time ($T^2$), a simulated roll distance ($R_s$) may be accurately calculated from the following formula:

$$R_s = \text{Antilog}\ (MD_f/T^2 + B)$$

where M and B are appropriate predetermined values depending on the type of golf course surface up which the ball lands. The predetermined values may also take into account a slope of the initial impact point. Other factors, such as grass height, course condition, and the like, can also be included. The simulated roll distance is added to the linear flight distance to yield a total simulated shot distance. As would be readily understood by those skilled in the art, a difference in elevation between the actual impact point and a simulated impact point may also be factored into the total simulated distance. The total simulated shot distance can also include the effects of external factors, such as wind speed at the driving range, the air density, and/or other weather conditions because the actual flight of the golf ball is influenced by these.

As also will be readily understood by those skilled in the art, predetermined values of M and B for the calculation of the simulated shot total distance may be stored in computer memory and may also be correlated to the initial impact position of the struck golf ball on the simulated golf hole from the golf course file 54. For example, if the struck golf ball were sliced so that it would have landed in the rough on the simulated golf hole layout, a correspondingly short roll distance would be added to the linear flight distance. In contrast, if the struck ball hit straight down the center of the golf hole fairway, a longer simulated roll distance could be applied. Hence, a plurality of actual golf shot time and distance can be stored for subsequent statistical or other mathematical analysis.

Figure 5:
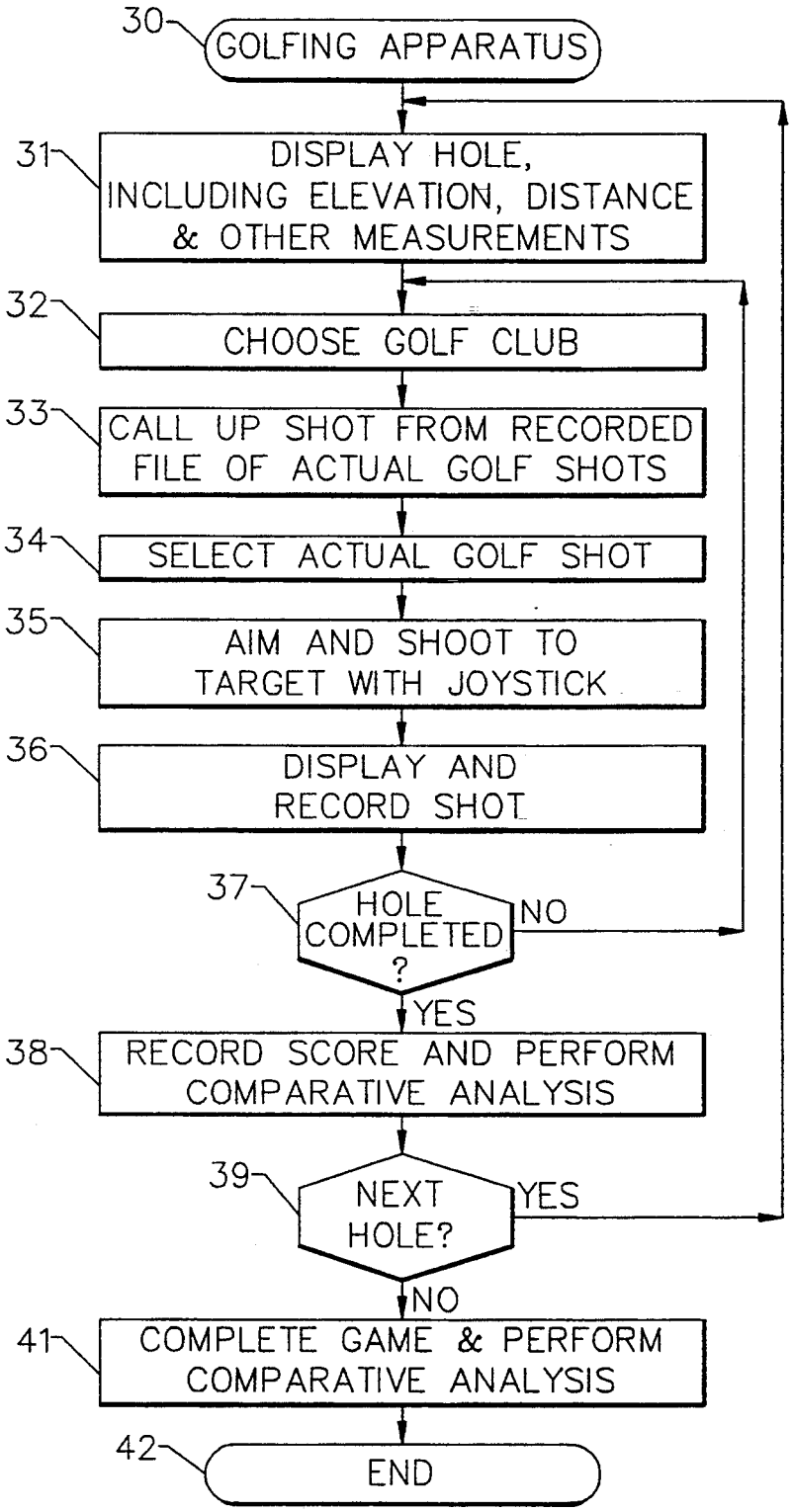
FIG. 5 is a schematic block diagram of the use of the golfing apparatus according to the present invention.

FIG. 5 shows in a schematic block diagram operation of the golfing apparatus 50 starting at block 30. As described above with reference to FIGS. 3 and 4, the image display 62 visually displays a hole and describes the elevation, distance, and other measurements related to the golf course contour as shown in block 31. The golfer chooses a club by interaction with the joystick 61 or keyboard 59 and a recorded actual shot is selected from the file or database of actual golf shots, blocks 32, 33. The golfer then aims and shoots with the joystick 61 and the shot is displayed on the image display as shown in blocks 34, 35. The shot is recorded and the player selects another club if the hole is not complete, block 36. If the hole is complete, block 37, the score for that hole is recorded and comparative analysis is performed either with another player or with the user's previous results, block 38. The image display shows the next hole and play continues until the round of golf, typically 18 holes, is complete as shown by block 39. Again, as shown by block 41, comparative analysis on partial or the entire round of golf may be performed against other players or with the user's previous results at the end of the round of golf, block 42.

Figure 6:
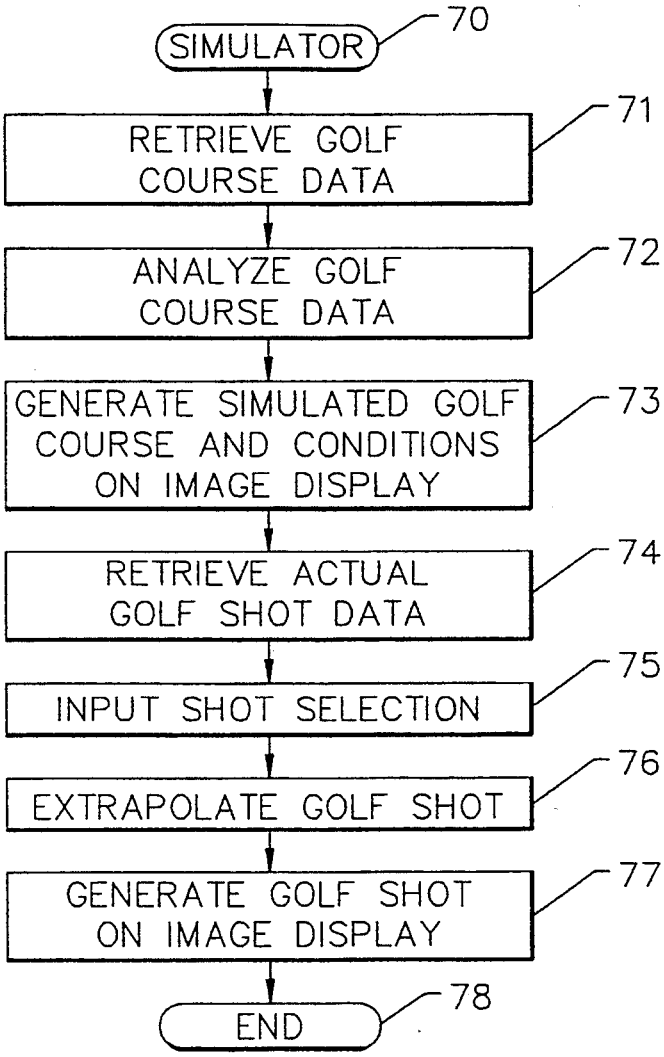
FIG. 6 is a schematic block diagram of the operation of a simulator of the golfing apparatus according to the present invention.

FIG. 6 is a schematic block diagram of the operation, block 70, of the simulator 63 according to the present invention. The simulator 63 retrieves selected golf course data representative of geographic information from the golf course file 54 as shown by block 71. The golf course data is then analyzed, block 72, and processed by the simulator 63. The simulator 63 generates at least portions of a golf course on the image display 62, block 73, and golf shot data from the golf shot file 51 is then retrieved for interaction on the simulated golf course, block 74. The user may then select a particular club for use with the simulated shot and may select an actual golf shot from the golf shot file 51 by use of an input device such as the keyboard 59 or the joystick 61, block 75. The data for an actual golf shot can be chosen either randomly or a particular actual golf shot at user request. Also, the data can be representative of an average of actual golf shots, i.e., 25 9-iron shots, taken by the user. The data representative of the average of the actual golf shots can be used for the simulated shot or data representative of an average of a subset of the actual shots, i.e., 6 of the 25 9-iron shots, can be used. The actual golf from the golf shot file 51 can then by extrapolated to the simulated conditions of the simulated golf course being played by the user, block 76. The simulated golf shot can be generated to the image display 62, block 77, for the user to observe. This process can then be continued as described above with reference to FIG. 5 until the hole and course are completed, block 78.

Figure 7A:
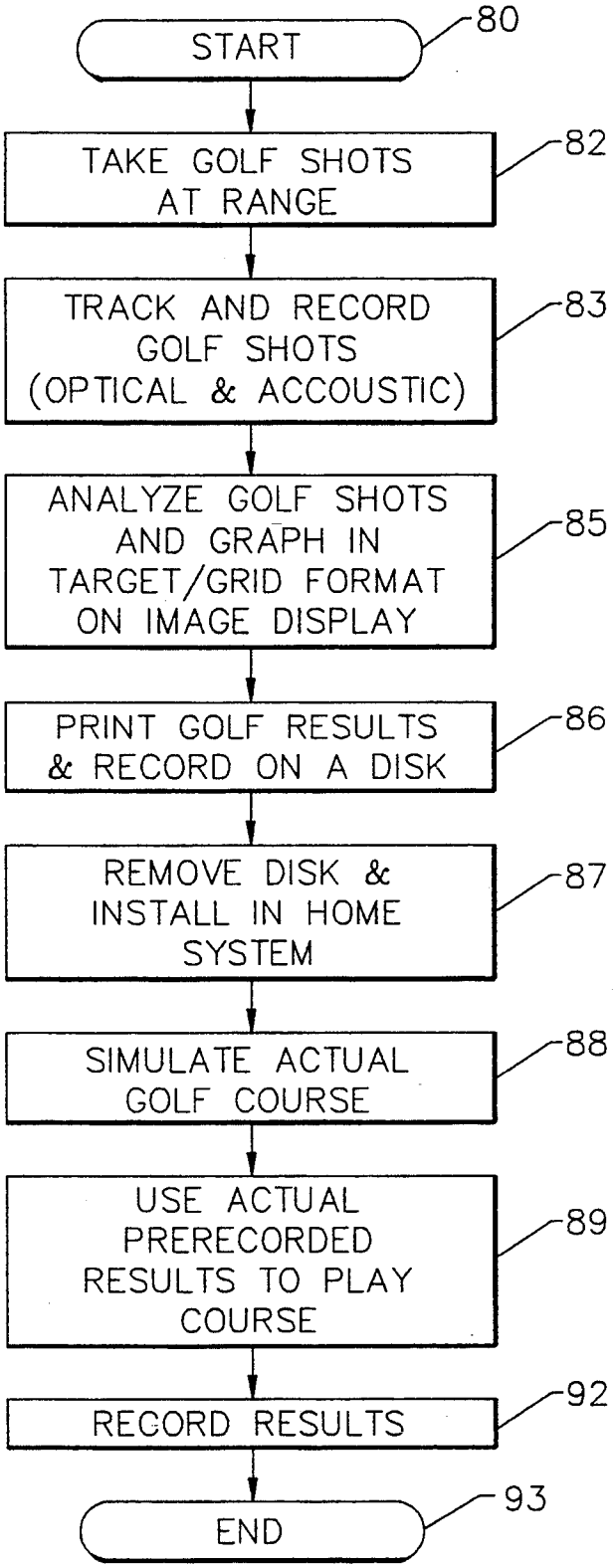
FIGS. 7A and 7B are schematic block diagrams of respective first and second embodiments of operations performed by the golf ball tracking and golfing simulation apparatus according to the present invention.
Figure 7B:
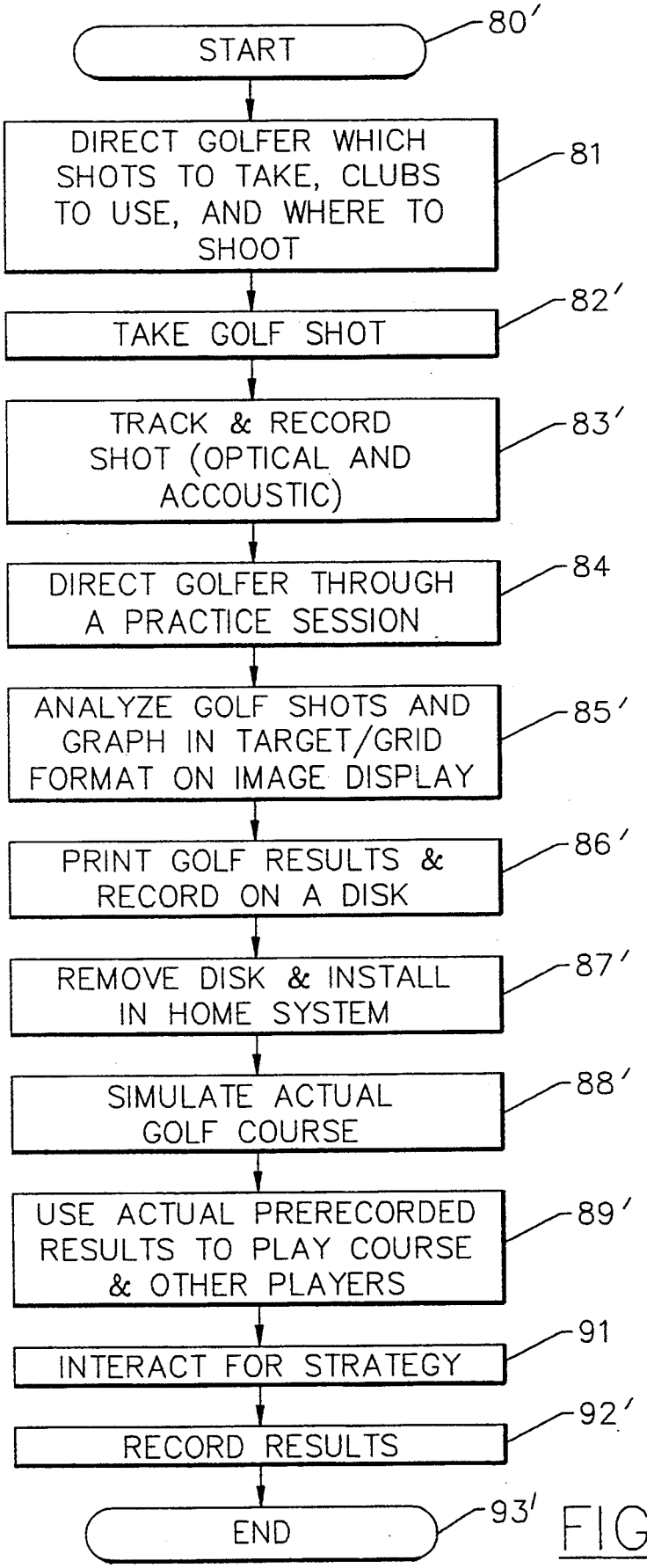

FIGS. 7A and 7B are schematic block diagrams of respective first and second embodiments illustrating operation of the golfing apparatus 50, like elements of the first and second embodiments being represented by use of prime (') notation. Initially, the golfer 24 may choose to hit only one type of golf club, such as a 3-wood or a 9-iron, or may choose to hit a combination of several clubs. Preferably, however, the golfer 24 hits all the golf clubs in a typical set Or a customized set of golf clubs in order to have the capability to simulate the golfer's actual shots when playing a round of golf on an 18 hole golf course. A computer 25, as shown in FIG. 1 with an image display 26, a keyboard 27, and a support stand 28, may interactively communicate with the golfer 24 to direct him on which club to use, which shots to take, and where to aim before each shot, as shown by block 81 of FIG. 7B. As a golf shot is taken, block 82, 82', the golf shot is tracked as described above and the computer 25 in communication with the video cameras and acoustic sensors 22 processes the data representative of the golf ball flight and roll for each golf shot in a similar manner as described in the aforementioned patents and patent applications which are incorporated by reference.

As illustrated by blocks 83, 83', the computer 25 records the actual golf shots on a recording medium such as a magnetic disk, an optical disk, or various integrated circuits (i.e., read only memory "ROM") to form or generate the golf shot data file 51. The golf shot results are analyzed and graphed in target or grid format (i.e., a graphic display of the position and/or distance of various golf shots), blocks 85, 85', on the image display 26 of the computer 25 shown in FIG. 1 or other image display 62 as schematically shown in FIGS. 3 and 4. As shown by block 34 of FIG. 7B, the computer 25 may provide interaction with the golfer 24 either in response to the keyboard 27 or in response to golf shots being hit or tracked, so as to direct the golfer 24 through a practice session with various golf clubs. The results, in turn, may be printed by a printer in communication with the computer 25 so that the user 24 may have a hard copy of the golfing session and record the various golf shots on a recording medium, blocks 86, 86'.

The recording medium, such as a disk, is removed if necessary, blocks 87, 87', and the recorded actual golf shots are then transferred to the golfing apparatus 50 according to the present invention for home use or the like, as shown in FIG. 2. The golfing apparatus 50 simulates golf play on an actual course by using the data representative of the recorded actual golf shots by the user, blocks 89, 89'. The user can play simulated golf courses and can play other golfers, including famous golfers, either using recorded information or using information such as shown on a television 90 when a tournament is actually occurring. The user enters the information about the conditions and golfer as received from the televised tournament and can then use the actual recorded golf shots from the user's own golfing session to simulate playing that particular golfer under the televised conditions. In turn, the user may develop strategy interaction, as shown in block 91 of FIG. 7B, based on knowledge of the user's own recorded shots and golfing skills and thereby compare the user's play with the famous golfer. As shown in blocks 92, 92', the results are recorded by the computer golfing apparatus 50.

The method as described in the drawings for simulating golf play uses recorded actual golf shots by a golfer. The steps include recording actual golf shots of the golfer and producing or generating data representative of at least one actual golf shot. The golf shot data, such as from the golf shot file 51, is then provided for use. The golf shot data preferably includes at least the time and distance of the golf shot. The steps further include providing data representative of at least a portion of a golf course such as from the golf course file 54, combining selected portions of the golf shot data and selected portions of the golf course data to simulate at least one golf shot on the selected portions of the golf course based upon at least one actual golf shot by the user such as by use of the simulator 57, and displaying golf play on an image display 62. Data may also be received by the simulator 63 from the user in response to user interaction with an input device such as the keyboard 59 or the joystick 61.

The step of providing golf shot data further includes the steps of analyzing a plurality of recorded actual golf shots according to a predetermined set of instructions, such as from the user through the keyboard 59 or joystick 61, and generating data representative of a selected golf shot. The step of providing golf course data has the steps of analyzing golf shot data according to a predetermined set of instructions and generating data representative of selected golf shot data.

In the drawings and specification, there have been disclosed typical preferred embodiments of the invention and, although specific terms are employed, they are used in a generic and descriptive sense only and not for the purposes of limitation. The invention has been described in considerable detail with specific reference to various preferred embodiments. It will be apparent, however, that various modifications and changes can be made within the spirit and scope of the invention as described in the foregoing specification and defined in the appended claims.

That which is claims is:

1. An apparatus for simulating golf play using an actual golf shot by a user, the apparatus comprising:

a golf shot file comprising a representation of a plurality of actual golf shots with each golf club in a set thereof, said golf shot representation including at least a time and a distance of a golf ball travel;

a golf course file comprising a geographic representation of at least a portion of a golf course;

simulation means for combining selected portions of said golf shot file and selected portions of said golf course file to simulate a plurality of golf shots on the selected portions of the golf course based upon a plurality of golf shots by the user; and image displaying means responsive to said simulation means for displaying a plurality of simulated golf shots on the selected portions of the golf course.

2. The apparatus according to claim 1, wherein said golf shot representation further comprises golf ball roll and wherein said simulation means is responsive to the representation of golf ball roll.

3. The apparatus according to claim 1, wherein said golf course file further comprises weather representations and wherein said simulation means is responsive to the weather representations.

4. The apparatus according to claim 1, further comprising means responsive to user inputs for selecting predetermined portions of said golf shot file.

5. The apparatus according to claim 4, wherein said input means is further responsive to said golf course file.

6. The apparatus according to claim 4, wherein said simulation means selects among data in said golf shot file in response to real time interaction of user with said input means.

7. The apparatus according to claim 1, wherein said simulation means further comprises extrapolation means for extrapolating actual golf shot data with the conditions of the simulated selected portions of the golf course.

8. The apparatus according to claim 1, wherein said simulation means further comprises means for analyzing said plurality of golf shots according to a predetermined set of instructions and generating means responsive to said input means for generating the data representative of said selected golf shot.

9. An apparatus for simulating golf play using an actual golf shot by a user, the apparatus comprising:

means for monitoring a plurality of actual golf shots by a golfer and generating a golf shot file therefrom including at least a time and a distance of a golf ball travel;

a golf shot file comprising a representation of a plurality of actual golf shots with each golf club in a set thereof, said golf shot representation including at least a time and a distance of a golf ball travel;

a golf course file comprising a geographic representation of at least a portion of a golf course;

simulation means for combining selected portions of said golf shot file and selected portions of said golf course file to simulate a plurality of golf shots on the selected portions of the golf course based upon a plurality of golf shots by the user; and image displaying means responsive to said simulation means for displaying a plurality of simulated golf shots on the selected portions of the golf course; and input means responsive to user input for selecting predetermined portions of said golf shot file.

10. The apparatus according to claim 9, wherein said golf shot representation further comprises golf ball roll and wherein said simulation means is responsive to the representation of golf ball roll.

11. The apparatus according to claim 9, wherein said golf course file further comprises weather representations and wherein said simulation means is responsive to the weather representations.

12. The apparatus according to claim 9, wherein said input means is further responsive to said golf course file.

13. The apparatus according to claim 9, wherein said simulation means further comprises extrapolation means for extrapolating actual golf shot data with the conditions of the simulated selected portions of the golf course.

14. The apparatus according to claim 9, wherein said simulation means further comprises means for analyzing said plurality of golf shots according to a predetermined set of instructions and generating means responsive to said input means for generating the data representative of said selected golf shot.

15. The apparatus according to claim 9, wherein said simulation means selects among data in said golf shot file in response to real time interaction of user with said input means.

16. A method for simulating golf play using actual golf shots by a user, comprising the steps of:

providing data representative of at least one actual recorded golf shot, the golf shot data including at least a time and a distance of a complete golf ball flight path;

providing data representative of at least a portion of a golf course; and combining selected portions of the golf shot data and selected portions of the golf course data to simulate at least one golf shot on the selected portions of the golf course based upon at least one actual golf shot by the user.

17. The method according to claim 16, wherein the step of providing golf shot data is preceded by the steps of:

recording at least one actual golf shot by the user; and producing golf shot data representative of at least one actual the golf shot by the user.

18. The method according to claim 16, further comprising the step of displaying at least one golf shot on selected portions of a golf course based upon at least one actual golf shot by the user.

19. The method according to claim 16, further comprising the step of receiving data from the user responsive to the golf shot data.

20. The method according to claim 16, wherein the step of providing golf shot data further comprises the steps of analyzing a golf shot according to a predetermined set of instructions and generating data representative of the golf shot.

21. The method according to claim 16, wherein the step of providing golf course data further comprises the steps of analyzing golf course data according to a predetermined set of instructions and generating data representative of selected golf course data.

22. An apparatus for simulating golf play using an actual golf shot by a user, the apparatus comprising:

a golf shot file comprising a representation of at least one actual golf shot by the user, said golf shot representations including at least a time and a distance of a complete golf ball flight path;

a golf course file comprising a geographic representation of at least a portion of a golf course;

simulation means for combining selected portions of said golf shot file and selected portions of said golf course file to simulate at least one golf shot on the selected portions of the golf course based upon at least one actual golf shot by the user; and image displaying means responsive to said simulation means for displaying at least one simulated golf shot on the selected portions of the golf course.

23. The apparatus according to claim 22, wherein said golf shot representation further comprises golf ball roll and wherein said simulation means is responsive to the representation of golf shot roll.

24. The apparatus according to claim 22, wherein said golf course file further comprises weather representations and wherein said simulation means is responsive to the weather representations.

25. The apparatus according to claim 22, further comprising means responsive to user inputs for selecting predetermined portions of said golf shot file.

26. The apparatus according to claim 25, wherein said input means is further responsive to said golf course file.

27. The apparatus according to claim 25, wherein said simulation means selects among data in said golf shot file in response to real time interaction of user with said input means.

28. The apparatus according to claim 22, wherein said simulation means further comprises extrapolation means for extrapolating actual golf shot data with the conditions of the simulated selected portions of the golf course.

29. The apparatus according to claim 22, wherein said golf shot file comprises a plurality of actual golf shots with each golf club in a predetermined set of golf clubs.

30. The apparatus according to claim 29, wherein said simulation means further comprises means for analyzing said plurality of golf shots according to a predetermined set of instructions and generating means responsive to said input means for generating the data representative of said selected golf shot.

* * * * *